US006500081B1

(12) United States Patent
Chen

(10) Patent No.: US 6,500,081 B1
(45) Date of Patent: Dec. 31, 2002

(54) CURVE ENHANCING STITCHED BASEBALL AND SOFTBALL

(75) Inventor: Shyi-Ming Chen, 1510 Chippendale Road, West Vancouver, British Columbia (CA), V7S 3G6

(73) Assignee: Shyi-Ming Chen, West Vancouver (CA)

( * ) Notice: Subject to any disclaimer, the term of this patent is extended or adjusted under 35 U.S.C. 154(b) by 0 days.

(21) Appl. No.: 09/312,859

(22) Filed: May 17, 1999

(51) Int. Cl.[7] ..... A63B 37/12
(52) U.S. Cl. ..... 473/598; 473/607
(58) Field of Search ..... 473/458–461, 473/598–609

(56) References Cited

U.S. PATENT DOCUMENTS

| | | | | | |
|---|---|---|---|---|---|
| 1,861,157 | A | * | 5/1932 | Grady | 473/598 |
| 1,960,803 | A | * | 5/1934 | Baumer | 473/598 |
| 1,980,472 | A | * | 11/1934 | Clarke | 473/598 |
| 2,300,062 | A | * | 10/1942 | Radford | 473/607 |
| 2,684,106 | A | * | 7/1954 | Fegan | 473/598 |
| 4,880,233 | A | * | 11/1989 | Song | 473/598 |
| 5,253,865 | A | * | 10/1993 | Kinnee | 473/598 |
| 5,665,188 | A | * | 9/1997 | McClure et al. | 156/93 |
| 5,772,544 | A | | 6/1998 | Yang | |
| 6,190,273 | C1 | * | 2/2001 | Maxey et al. | 473/598 |

* cited by examiner

*Primary Examiner*—Paul T. Sewell
*Assistant Examiner*—Mitra Aryanpour
(74) *Attorney, Agent, or Firm*—Kelly H. Hale

(57) ABSTRACT

The present invention relates to a novel construction of a ball and, more particularly, to a novel construction of baseball, such as a hardball or a softball which has enhanced curve characteristics. The invention relates to a ball comprising: (a) a spherical core; (b) a first flexible cover member formed approximately in the shape of a figure 8, and having the peripheral edge folded under and a series of thread holes penetrating through the cover member adjacent the folded under edge; (c) a second flexible cover member formed approximately in the shape of a figure 8 and having the peripheral edge folded under and a series of thread holes penetrating through the cover member adjacent the folded-under edge; and (d) a first thread and a second thread which, when the first and second cover members are placed in an intersecting mating pattern over the spherical core, penetrate in alternating intersecting pattern the thread holes in the areas adjacent the intersecting folded-under edges of the first and second cover members, to thereby completely enfold and cover the spherical core and create a ball which has raised areas around the adjacent intersections of the first and second cover members.

2 Claims, 3 Drawing Sheets

FIG. 5
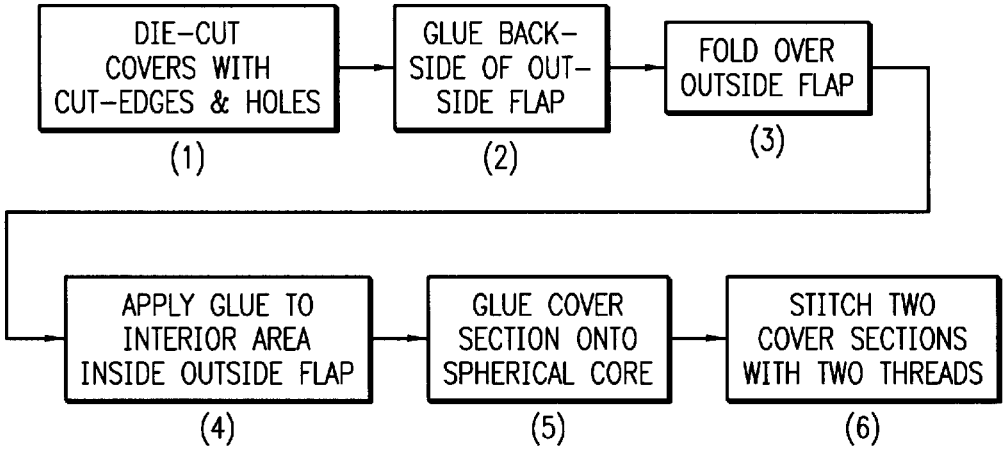
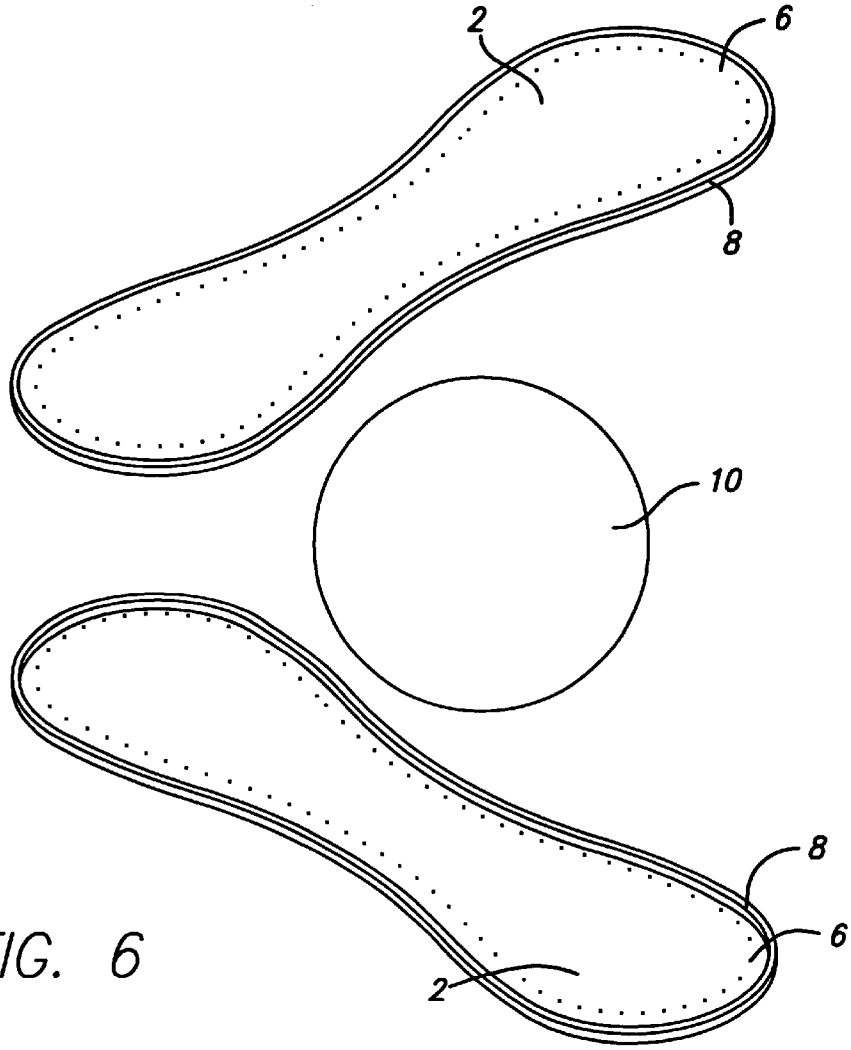
FIG. 6

CURVE ENHANCING STITCHED BASEBALL AND SOFTBALL

FIELD OF THE INVENTION

The present invention relates to a novel construction of a ball and, more particularly, to a novel construction of baseball, such as a hardball or a softball which has enhanced curve characteristics.

BACKGROUND OF THE INVENTION

Typical baseballs (hardballs) and softballs comprise a solid core and two outer FIG. 8-type covers enclosing the core. The outer covers normally comprise two intersecting 8-shaped members, made of leather, the intersections of which are hand stitched together by thread, to thereby envelop the core. A problem with conventional baseballs is that after the stitching operation, the thread stitching the two covers together is exposed. The threads become worn after usage, often to the point that the thread becomes broken. Once the threads become broken, the two covers start to separate from the core and the baseball becomes useless.

U.S. Pat. No. 5,772,544, granted Jun. 30, 1998, Yang, discloses a baseball or a softball which includes two or more cover members engaged on the outer portion of a core and having an abutting peripheral portion. A pad is engaged between the core and the abutting peripheral portion of the two cover members and is stitched and secured to the abutting peripheral portion of the cover members by a thread. When the thread is tightened, a number of bulges may be formed along the abutting peripheral portions of the cover members. The thread becomes embedded in and protected by the bulges. Thus they are protected from being worn out easily.

SUMMARY OF THE INVENTION

An objective of the present invention is to provide a baseball which can be easily gripped and curves sharply when thrown.

A second objective is to provide a baseball or a softball in which the thread for securing the two cover members together is embedded in the adjoining seams and is thus suitably protected from being abraded and easily worn out.

In accordance with one aspect of the invention, there is provided a ball comprising a core, at least two flexible cover members enveloping the core and including an abutting folded-under peripheral portion for each of the two cover members, and two threads stitched in interlocking fashion through the abutting folded-under peripheral portions of the two cover members for securing the abutting peripheral portions of the two cover members together. The stitched edges form bulges on the abutting peripheral portions of the two cover members. These bulges increase air drag when the ball is pitched with a spin and thereby enhance the curve characteristics of the ball.

The invention is directed to a ball comprising: (a) a spherical core; (b) a first flexible cover member formed approximately in the shape of a FIG. 8, and having the peripheral edge folded under and a series of thread holes penetrating through the cover member adjacent the folded-under edge; (c) a second flexible cover member formed approximately in the shape of a FIG. 8 and having the peripheral edge folded under and a series of thread holes penetrating through the cover member adjacent the folded-under edge; and (d) a first thread and a second thread which, when the first and second cover members are placed in an intersecting mating pattern over the spherical core, penetrate in alternating intersecting pattern the thread holes in the areas adjacent the intersecting folded-under edges of the first and second cover members, to thereby completely enfold and cover the spherical core and create a ball which has raised areas around the adjacent intersections of the first and second cover members.

The invention is also directed to a method of constructing a ball constructed of a spherical core, a first cover formed approximately in the shape of a FIG. 8, and a second cover formed approximately in the shape of a FIG. 8, which comprises forming cuts in the peripheries of the two covers adjacent the edges, the cuts partially penetrating the thickness of the two cover members, punching a series of thread holes through the folded peripheries of the first and second covers, folding the peripheries of the first and second covers under along the two cuts to provide first and second covers which have peripheries which are double the thickness of the main body area of the two covers, gluing the folded peripheries to the corners, gluing the areas of the two covers between the folded-under peripheries, placing the first and second covers with the folded-under peripheries over the spherical core to completely enclose the surface of the spherical core, and stitching the folded-under peripheries of the first and second covers together in intersecting manner with a pair of elongated threads, to thereby provide a ball with raised intersecting areas.

The baseball, according to my invention, by having intersecting fold-under seams, and stitching, creates a baseball which provides a better grip for the pitcher. The raised seams enable the pitcher's fingers to readily grip the seams and thus impart improved pitching control over the baseball. Furthermore, since the intersecting fold-under seams of the baseball are folded under, thereby raising the profile of the seams, the baseball according to my invention creates more air-drag and thus the baseball, when rotated rapidly by the pitcher snapping his pitching hand and arm, curves more sharply than conventional baseballs when approaching home plate. The baseball according to my invention can be used to construct both hardballs and softballs, and any other ball design which has a cover that is stitched.

BRIEF DESCRIPTION OF DRAWINGS

In drawings which illustrate specific embodiments of the invention, but which should not be construed as restricting the spirit or scope of the invention in any way:

FIG. 5 illustrates a schematic flow chart of the steps that are followed to construct a baseball.

FIG. 6 is an exploded view of the ball with solid core and two 8-shaped cover members.

DETAILED DESCRIPTION OF A PREFERRED EMBODIMENT OF THE INVENTION

Figure 7:
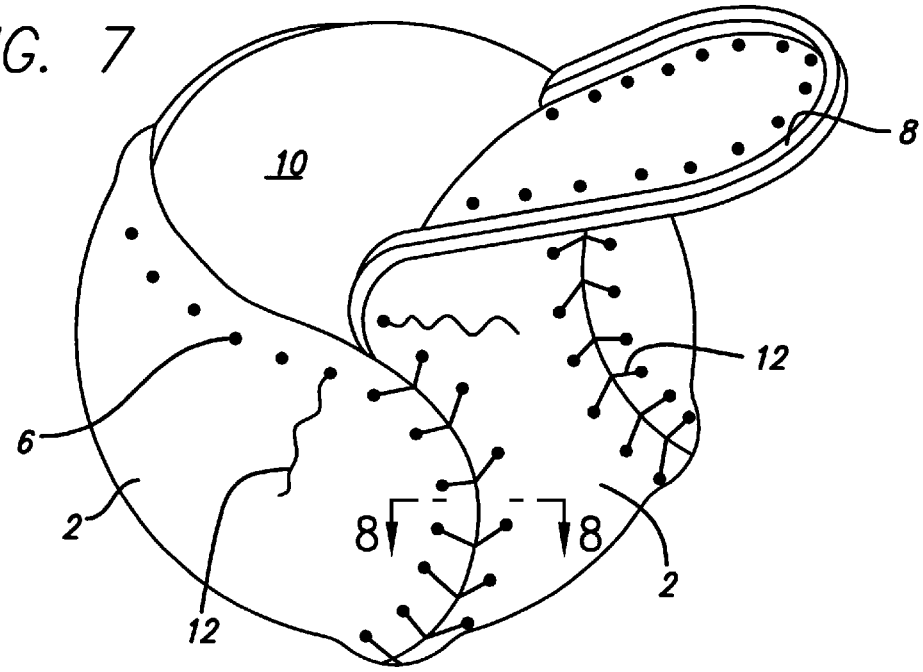
FIG. 7 is a perspective view of a ball in accordance with the present invention, in which a portion of one of the two cover members is opened, exposing the solid core.
Figure 8:
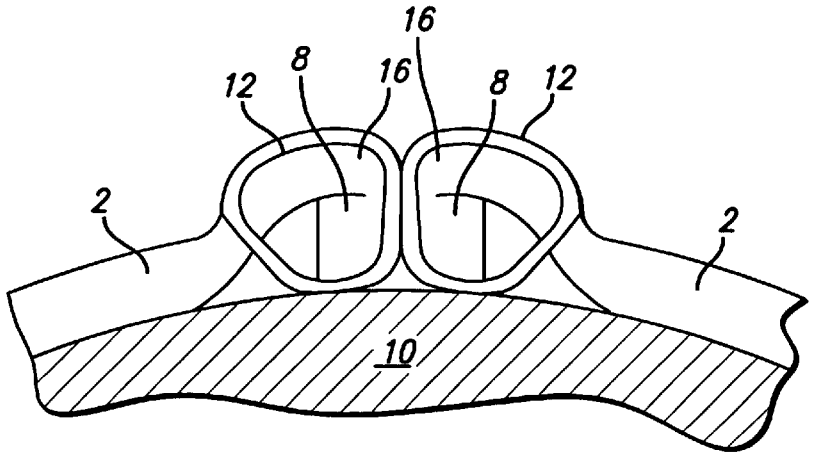
FIG. 8 is a cross-sectional view taken along section line 8—8 of FIG. 7, showing the adjacent fold-under seams of the two cover members, and the interlocking threads.

Referring to the drawings, and initially to FIGS. 6 and 7, a ball in accordance with the present invention may either be a baseball or a softball, or any other ball that is constructed with a hard spherical core and a cover of two FIG. 8 members stitched together with intersecting threads. The ball comprises a core 10 and a pair of outer two-piece FIG. 8 covers 2 engaged on the outer portion of the core 10. The pair of outer covers 2 are stitched together along the abutting peripheral portions by a pair of intersecting threads 12. Each 8-shaped cover 2 has a series of thread holes 6 punched around its circumference spaced from the edge.

Figure 1:
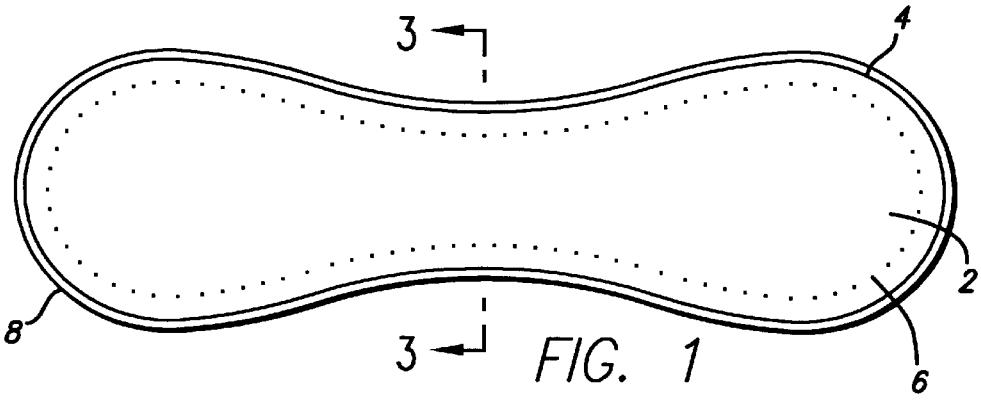
FIG. 1 illustrates a plan view of a FIG. 8 cover punched with a cut fold edge around but spaced from the periphery of the cover and a series of thread holes punched in the cover inside and spaced from the cut fold edge.
Figure 2:
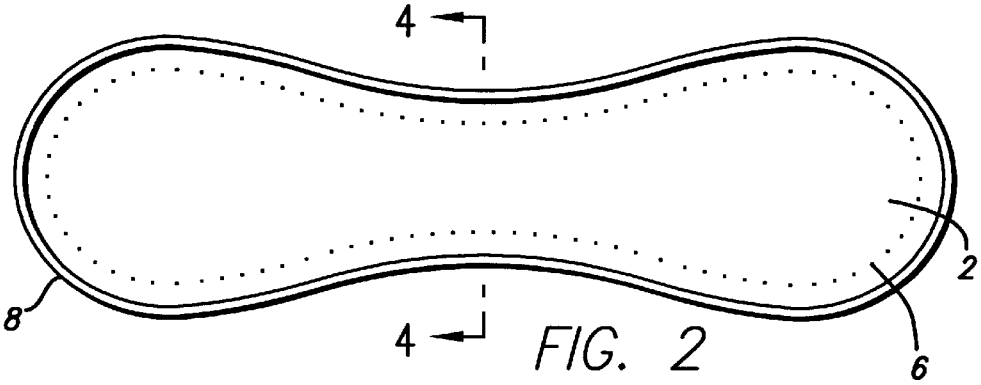
FIG. 2 illustrates a plan view of the underside of the FIG. 8 cover of FIG. 1 with the run of the cover folded over along the cut fold edge.

FIG. 1 illustrates a plan view of a FIG. 8 cover punched with a cut fold edge around but spaced from the periphery of the cover and a series of thread holes punched in the cover inside and spaced from the cut fold edge. FIG. 2 illustrates a plan view of the underside of the FIG. 8 cover of FIG. 1 with the run of the cover folded over along the cut fold edge. As seen in FIG. 1, the 8-shaped cover 2 has been punched by a die to form a cut fold edge around but spaced inside the peripheral edge of the cover 2. A series of thread holes 6 has also been punched by the same die around the periphery of the cover 2, but located inside the cut fold edge 4. As seen in FIG. 1, the peripheral edge 6 of the cover 2 is cut oversize so that when the rim 8 is folded over as seen in FIG. 2, the periphery of the cover 2 assumes the correct size. The same is true of the other cover 2.

After the cut fold edge 4 and the thread holes 6 are punched in the cover 2, the underside area of the cover 2 between the cut edge 4 and the periphery is glued. The rim 8 is then folded under so that the cover 2 has the configuration shown in FIG. 2.

As seen in FIGS. 1 and 2, the series of thread holes 6 have been punched in the cover 2 prior to gluing and folding the edge 8 over (under). However, in many cases, it may be more convenient or advantageous to punch the thread holes 6 after the edge 8 has been glued and folded over (under).

Figure 3:
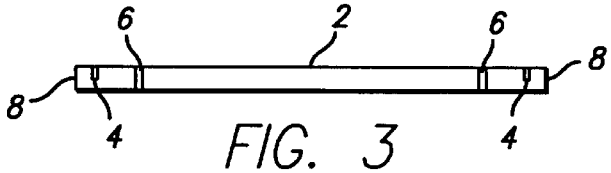
FIG. 3 illustrates a section view taken along section line 3—3 of FIG. 1.
Figure 4:
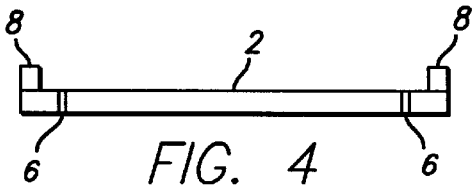
FIG. 4 illustrates a section view taken along section line 4—4 of FIG. 2.

FIG. 3 illustrates a section view taken along section line 3—3 of FIG. 1. FIG. 4 illustrates a section view taken along section line 4—4 of FIG. 2. Specifically, FIG. 3 shows how the thread holes 6 penetrate through the cover 2 while the cut for the fold edge 4 only partially penetrates the thickness of the cover 2. After the underside of the fold under run 8 formed by the area between the cut 4 and the periphery of the cover 2 is glued, the rim 8 is folded under (over) to achieve the configuration illustrated in FIG. 4.

FIG. 5 illustrates a schematic flow chart of the steps that are followed to construct a baseball. As seen in FIG. 5, in step (1), the cover is die-cut to form the cut edge 4 and the thread holes 6. In step (2), the underside of the area between the cut edge 4 and the periphery is glued. In step (3), the rim 8 is folded over and is held by the glue. In step (4), glue is applied to the underside of the cover in the central area between the folded over (under) rim 8. In step (5), the glue bearing cover 2, along with another similar glued cover 2, are glued over the surface of the core 10 in intersecting pattern. In step (6), the two cover sections are stitched together with a pair of threads, in a manner similar to the way laces are tied in shoes.

Referring to FIG. 6, which shows an exploded view of the components of the baseball, in association with FIG. 1, the two covers 2, 2 have the rim edges 8 folded over to form edges that are sized to engage with one another when the two covers 2, 2 are glued on the core 10 and threaded together and tightened during the stitching operation, as seen in FIG. 7. The fold over rims 8 form bulges when the abutting peripheral edges of the two cover members 2, 2 are tightly secured together by the pair of threads 12. The bulging edges allow the two threads 12 to be embedded into the abutting peripheral edges of the two cover members 2, 2. These bulges along the periphery of each of the two cover members permit better gripping of the ball and by increasing air-drag enable the ball to curve more sharply when thrown. The two interwoven threads 12, by being embedded in the adjacent bulges, are also prevented from being abraded and easily broken.

FIG. 8 illustrates a section view taken along section line 8—8 of FIG. 7. As can be seen, the adjacent edges of the two covers 2, 2 meet and the fold over (under) edge rims 8 are folded under the respective edges 16. The two threads 12 pass in alternating manner through the respective thread holes 12 and stitch the two covers 2, 2 tightly together. The glue holds the two covers 2, 2 securely on the core 10.

In U.S. Pat. No. 5,772,544, Yang, granted Jun. 30, 1998, it is necessary to use two FIG. 8 pads 30, which respectively rest under the intersecting areas of the two cover members 20 and are then stitched together with the adjacent peripheral areas of the first and second covers by a pair of threads 40. A problem with this construction of baseball is that the two pads 30 must be precisely positioned under the intersecting areas of the two respective cover members 20. Furthermore, when the two pads 30 and the two cover members 20 are stitched together, the stitching needle, when inserted, can cause the two pads 30 to squirm out of place slightly, thereby adversely affecting the overall uniformity and balance of the baseball. Baseballs which are not properly balanced are rejected in organized baseball games.

A big advantage with the baseball according to my invention is that it is not necessary to use two FIG. 8 pads under the two exterior leather covers. With the peripheral edges of the first and second covers folded under, the folded-under areas are fixed and cannot move out of position when the first and second covers are stitched together about the spherical core 10 by the pair of threads 12. Furthermore, with my baseball design, there is only the core 10 and the two covers 2. No foreign elements such as a pad 30 (Yang) are required. The consistency of the baseball is therefore uniform. A baseball according to my invention is acceptable to organized baseball authorities.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method of constructing a baseball constructed of a spherical core, a first cover formed approximately in the shape of a FIG. 8, and a second cover formed approximately in the shape of a FIG. 8, which comprises forming cuts in the peripheries of the two covers adjacent the edges, the cuts partially penetrating the thickness of the two cover members, punching a series of thread holes through the folded peripheries of the first and second covers, folding the peripheries of the first and second covers under along the two cuts to provide first and second covers which have peripheries which are double the thickness of the main body area of the two covers, gluing the folded periphery to the cover along the edges, placing the first and second covers with the folded-under peripheries over the spherical core to completely enclose the surface of the spherical core, and using two threads stitching the folded-under peripheries of the first and second covers together in intersecting and overlapping manner with a pair of elongated threads, to thereby provide a ball with exposed stitching in raised intersecting areas.

2. A method as claimed in claim 1 wherein the thread holes are punched in the two covers before the peripheral edges are folded under.

* * * * *